US006184670B1

(12) United States Patent
Mulatti et al.

(10) Patent No.: US 6,184,670 B1
(45) Date of Patent: Feb. 6, 2001

(54) MEMORY CELL VOLTAGE REGULATOR WITH TEMPERATURE CORRELATED VOLTAGE GENERATOR CIRCUIT

(75) Inventors: Jacopo Mulatti, Latisana; Matteo Zammattio, Milan; Andrea Ghilardelli, Cinisello B.; Marcello Carrera, Trescore, all of (IT)

(73) Assignee: STMicroelectronics S.r.l., Agrate Brianza (IT)

( * ) Notice: Under 35 U.S.C. 154(b), the term of this patent shall be extended for 0 days.

(21) Appl. No.: 09/186,498

(22) Filed: Nov. 4, 1998

(30) Foreign Application Priority Data

Nov. 5, 1997 (EP) ..... 97830574.6

(51) Int. Cl.[7] ..... G05F 3/16
(52) U.S. Cl. ..... 323/314; 323/907
(58) Field of Search ..... 323/313, 314, 323/907

(56) References Cited

U.S. PATENT DOCUMENTS

| | | | | |
|---|---|---|---|---|
| 4,298,835 | | 11/1981 | Rowe | 323/281 |
| 5,434,533 | | 7/1995 | Furutani | 327/538 |
| 5,545,977 | | 8/1996 | Yamada et al. | 323/313 |
| 5,703,476 | * | 12/1997 | Merlo et al. | 323/907 |
| 5,929,621 | * | 7/1999 | Angelici et al. | 323/313 |
| 5,955,873 | * | 9/1999 | Maccarrone et al. | 323/314 |

FOREIGN PATENT DOCUMENTS

| | | | |
|---|---|---|---|
| 0 504 974 | 9/1992 | (EP) | H01L/31/02 |
| 95/22093 | 8/1995 | (WO) | G05F/3/24 |

* cited by examiner

*Primary Examiner*—Jeffrey Sterrett
(74) *Attorney, Agent, or Firm*—Theodore E. Galanthay; David V. Carlson; Seed IP Law Group PLLC

(57) ABSTRACT

A temperature-related voltage generating circuit has an input terminal receiving a control voltage independent of temperature, and an output terminal delivering a temperature-related control voltage. The input and output terminals are connected together through at least an amplifier stage adapted to set an output reference voltage from a comparison of input voltages. The voltage generating circuit also includes a generator element generating a varying voltage with temperature and connected between a ground voltage reference and a non-inverting input terminal of the amplifier stage. The amplifier stage has an output terminal adapted to deliver a multiple of the varying voltage with temperature to an inverting input terminal of a comparator stage. The comparator stage has its output connected to the temperature-related voltage generating circuit and a non-inverting input terminal receiving the control voltage independent of temperature to evaluate the difference between the control voltage independent of temperature and said voltage being a multiple of the varying voltage with temperature and to output a temperature-related control voltage having at room temperature a mean value which is independent of its thermal differential and increases with temperature. The voltage generating circuit can be incorporated into a regulator for a drain voltage of a single-supply memory cell.

21 Claims, 3 Drawing Sheets

MEMORY CELL VOLTAGE REGULATOR WITH TEMPERATURE CORRELATED VOLTAGE GENERATOR CIRCUIT

TECHNICAL FIELD

This invention relates to a temperature-related voltage generating circuit.

Specifically, the invention relates to a temperature-related voltage generating circuit having an input terminal which receives a control voltage independent of temperature, and an output terminal which delivers a temperature-related control voltage, said input and output terminals being connected together through at least an amplifier stage adapted to set an output reference voltage from a comparison of input voltages.

The invention also relates to a regulator for a drain voltage of a single-supply memory cell, which comprises a differential stage having an inverting input terminal receiving a control voltage independent of temperature and a non-inverting input terminal suitably connected to an output terminal and to a ground voltage reference, and a booster circuit connected to said output terminal and to a supply terminal of the differential stage, said supply terminal being feedback connected to the output terminal and receiving a boosted voltage from the booster circuit.

More particularly, but not exclusively, the invention relates to a temperature-related voltage generating circuit for a cell of a flash memory constructed as a memory matrix having a plurality of sectors, and the description to follow uses this field of application for illustration purpose only.

BACKGROUND OF THE INVENTION

As is well known, electrically programmable non-volatile memories are constructed as matrices of cells, each comprising a floating gate MOS transistor having respective drain and source regions.

The floating gate is realized over the semiconductor substrate and isolated therefrom by a thin layer of gate oxide. A control gate is coupled capacitively to the floating gate through a dielectric layer. Metal electrodes are provided for contacting the drain, source and control gate in order to apply predetermined voltage values to the memory cell.

By suitably biasing the cell terminals, the amount of charge present in the floating gate can be varied. The operation whereby a charge is built up in the floating gate is called "programming", and consists of biasing the drain terminal and control gate to a predetermined value, higher than the potential of the source terminal.

A non-volatile memory circuit integrated in a semiconductor usually comprises a very large number of memory cells organized into rows (word lines) and columns (bit lines). Cells belonging to the same row share the line which drives their respective control gates. Cells belonging to the same bit line have the drain electrode in common. For programming a given cell, the word line and bit line which identify it must be applied suitable positive voltage values.

A memory cell programming is heavily affected by the voltage Vd applied to the drain terminal, that is, by the voltage present on the bit line to which that cell belongs.

In particular, for non-volatile memory cells of the FLASH type, a low value of said drain voltage Vd results in insufficient and slow programming of the cell, whereas an excessively high value results in the cell being partially erased (the so-called soft-erasing phenomenon). Thus, the optimum range for Vd is rather narrow, typically from 5 V to 6 V approximately.

The above considerations lead one to conclude that the memory circuit should be provided with a sophisticated and precise voltage regulator capable of supplying the appropriate voltage to the bit line during the programming phase.

A first prior approach to meeting this requirement is the so-called correlation by decoding, schematically illustrated in FIG. 1 for a non-volatile memory cell M1.

In particular, the memory cell M1 is connected between a ground voltage reference GND and a program voltage reference Vpp through a series of a voltage regulator 1, connected to the program voltage reference Vpp and to a program load 2, itself connected to the drain terminal D1 of the memory cell M1 via a column decoder 3.

The regulator 1 is effective to limit the current being flowed through the memory cell M1 during the programming phase, by smoothing a secondary program voltage Vpd, specifically the voltage present on a data bus BD between the program load 2 and the column decoder 3.

The program load 2 conventionally comprises a logic inverter IL1 and a transistor M2, specifically a PMOS type.

The drain voltage Vd of the memory cell M1 is therefore the difference between the secondary program voltage Vpd and a voltage $\Delta V_C$ equal to the drop across the chain of decode transistors Y0, YN, YM of the decoder 3 and the serial resistances rd of the bit line and rs of the source terminal:

$$Vd = Vpd - \Delta V_C \quad (1)$$

In order to limit this voltage drop $\Delta V_C$, the value of a voltage Vpcy to be applied to the gate terminals of the chain of decode transistors Y0, YN, YM of the decoder 3 should be raised such that they will keep within the so-called "triode" operating range.

For flash memory cells with a dual supply, an active adjustment of the voltage drop $\Delta V_C$ can be provided using a feedback differential regulator 4, as shown schematically in FIG. 2.

The differential regulator 4 is connected to the drain terminal D1 of the memory cell M1 through the column decoder 3, and comprises a differential stage 5, itself connected to a redundancy decoder 6, which is connected to the ground voltage reference GND and adapted to mirror a current $I_C$ flowing through the memory cell M1 during the programming phase, via the column decoder 3. This redundancy decoder 6 introduces a voltage drop equal to $\Delta V_D$.

The differential stage 5 has an inverting input terminal 7, a non-inverting input terminal 8, and an output terminal 9. A power supply terminal 10 of the differential stage 5 is further connected to the program voltage reference Vpp.

The inverting input terminal 7 of the differential stage 5 is connected to the ground potential reference GND through a bias transistor M3, spec ifically an NMOS type, which receives a control voltage $V_{BG}$ independent of temperature on its gate terminal, and through the column decoder 3.

The bias transistor M3 keeps the secondary program voltage Vpd stable outside the memory cell decoding phase, that is outside the current take-up phase of the cells.

The non-inverting input terminal 8 receiving a reference voltage Vref is connected, through a resistive divider R1/R2, to the redundancy decoder 6 and to the bias voltage reference Vpp.

The output terminal 9 is feedback connected to the non-inverting input terminal 8 through a current mirror configuration. In particular, the output terminal 9 is connected to the gate terminal of an output transistor M4, specifically an NMOS type, having its source terminal connected to the drain terminal of the bias transistor M3 and its drain terminal connected to the drain terminal of a first mirror transistor M5, specifically a PMOS type, in diode configuration, that is having its drain terminal connected to the gate terminal, and its source terminal connected to the program voltage reference Vpp.

Furthermore, the gate terminal of the first mirror transistor M5 is connected to the gate terminal of a second mirror transistor M6, specifically a PMOS type, having its source terminal connected to the program voltage reference Vpp and its drain terminal connected to the redundancy decoder 6 and connected to the ground voltage reference GND through an adjust transistor M7, specifically an NMOS type.

The adjust transistor M7 has its source terminal connected to the ground voltage reference GND and its gate terminal connected to the control voltage $V_{BG}$ independent of temperature. In particular, this adjust transistor M7 eliminates the mirror current contribution $K^*I_B$ from the bias transistor M3, which takes up a current $I_B$.

Finally, it should be noted that the output transistor M4 and bias transistor M3, shown separately for convenience of illustration, are actually parts of an operational amplifier which also includes the differential stage 5.

The architecture of FIG. 2 provides a drain voltage Vd for the memory cell M1 which is substantially independent of the current $I_C$ and of temperature, as by suitable selection of the mirror ratio K for the feedback configuration comprising the transistors M4, M5, M6 and the resistive divider R1/R2.

While achieving its objective, this approach has the following drawbacks:

- the final configuration of the feedback differential regulator 4, as shown in FIG. 2, is quite complicated, and the mirror ratio K varies with the number of cells to be programmed;
- this feedback differential regulator 4 cannot be used with memory cells having a single supply voltage.

For such memory cells with a single supply voltage, the high voltage values required for the programming phase must be derived by means of booster circuits, typically charge pumps, from the single supply voltage. When the configuration shown in FIG. 2 is used for the feedback differential regulator 4, the charge pumps for regulating the current to the drain terminal of the memory cell to be programmed should deliver a program voltage Vpp, exceeding the reference voltage Vref by a value at least equal to the threshold voltage of a PMOS transistor, so that the pumps have to be provided oversize.

A feedback differential regulator like that shown in FIG. 2, and intended for a memory cell M1 with a single supply voltage, would therefore be high in area occupation.

To obviate these drawbacks, the state of the art proposes a feedback differential regulator 11 with no adjustment feature, as shown schematically in FIG. 3.

This feedback differential regulator 11 effects no adjustment of the voltage drop $\Delta V_C$ across the column decoder 3, either for temperature variations or for the current $I_C$ which is flowing through the memory cells during the programming phase.

In essence, the secondary program voltage Vpd for the drain terminal D1 of the memory cell M1 is derived from a boosted voltage Vpump supplied by a charge pump booster circuit 13. This secondary program voltage Vpd is also set, when no current is being taken up by the memory cell, through the differential stage 5, to be a multiple of a control voltage $V_{BG}$ independent of the temperature which is generated by a so-called bandgap circuit 12 connected to the inverting input terminal 7 of the differential stage 5.

In this way, the secondary program voltage Vpd will be set under any operational conditions of the circuit, starting from a non-regulated boosted voltage Vpump. Thus, the charge pump booster circuit 13 functions as a current reservoir.

For the purpose, the output terminal 9 of the differential stage 5 is feedback connected to the power terminal 10 through an output transistor M8, specifically a PMOS type. In addition, the power terminal 10 receives the boosted voltage Vpump from the charge pump booster circuit 13.

The output transistor M8, being driven from the differential stage 5, thus sets the secondary program voltage Vpd either to the value of the boosted voltage Vpump supplied by the charge pump booster circuit 13 or a multiple value of the control voltage $V_{BG}$ independent of temperature generated by a so-called bandgap circuit 12, as by the following relation:

$$Vpd=(1+R1/R2)*V_{BG} \quad (2)$$

Similar as the differential regulator 4 of FIG. 2, the output transistor M8 has been shown separately for convenience of illustration, but would actually be a part of an operational amplifier also including the differential stage 5.

The non-inverting input terminal 8 of the differential stage 5 is connected to the column decoder 3 through a first resistive element R1 of the resistive divider R1/R2 and to the ground voltage reference GND through a second resistive element R2 of the divider.

However, the feedback differential regulator 11 with no adjustment feature has shortcomings, foremost among which is the fact that the equivalent series resistance RC of the column decoder 3 increases with temperature, thereby lowering the effective voltage applied to the drain terminal D1 of the cell to be programmed, for the same current $I_C$ taken up.

Illustratively, with a program current of 400 $\mu$A per cell, the voltage drop $\Delta V_C$ across the decoder 3 is approximately 200 mV at a temperature of−40° C., and reaches 350 mV at a temperature of 120° C.

Thus, it can be seen that the program voltage Vd regulation provided for the drain terminal D1 by the feedback differential regulator 11 without adjustment feature shown in FIG. 3 becomes quite inefficient as temperature increases, the voltage applied to the terminal D1 not being sufficiently high.

SUMMARY OF THE INVENTION

An object of this invention is to provide a voltage regulator for memory cells with a single supply voltage, which has such structural and functional features as to overcome the limitations and drawbacks which are besetting the regulators according to the prior art, as described above.

An embodiment of this invention provides a temperature-related voltage generating circuit in place of the so-called bandgap circuit, as a reference voltage generator in a feedback differential regulator without adjustment feature, such as the one described in relation to the prior art.

In particular, this temperature-related voltage generating circuit has the following features:

- an output voltage having a mean value close to the control voltage $V_{BG}$ independent of temperature of the bandgap circuit according to the prior art (at room temperature); and
- a constant positive drift of the output voltage against temperature.

In other words, the output voltage of the temperature-related voltage generating circuit according to the embodiment increases with temperature according to a known type of linear law.

The features and advantages of the temperature-related voltage generating circuit and the regulator according to embodiments of the invention will be apparent from the following description of embodiments thereof, given by way of non-limitative examples with reference to the accompanying drawings.

DETAILED DESCRIPTION OF THE INVENTION

Figure 1:
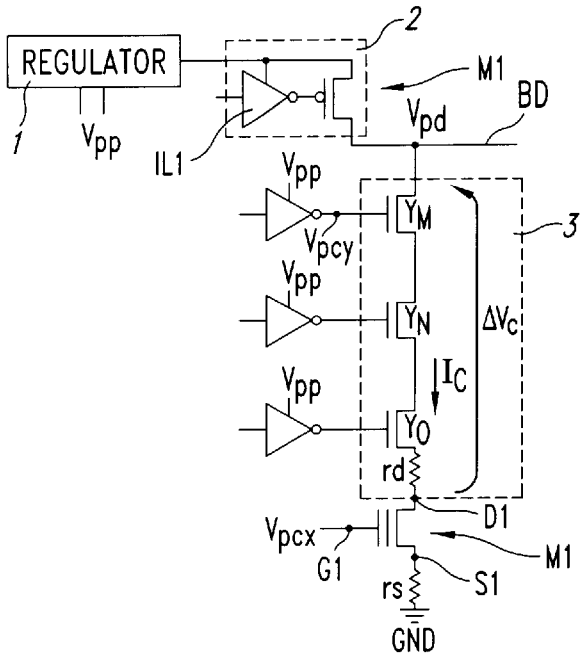
Fig. 1 (Prior Art)
FIG. 1 shows a program voltage regulation scheme for a conventional memory cell of the decoding type.
Figure 2:
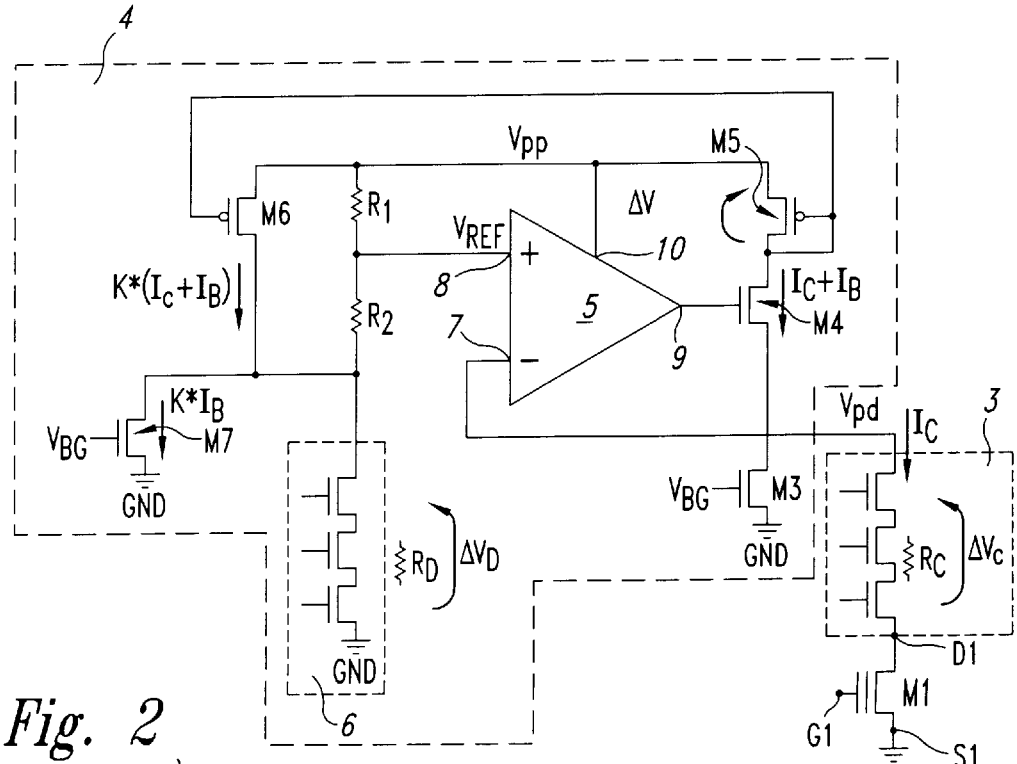
Fig. 2 (Prior Art)
FIG. 2 shows a feedback differential regulator with adjustment feature for a conventional memory cell with dual supply voltage.
Figure 3:
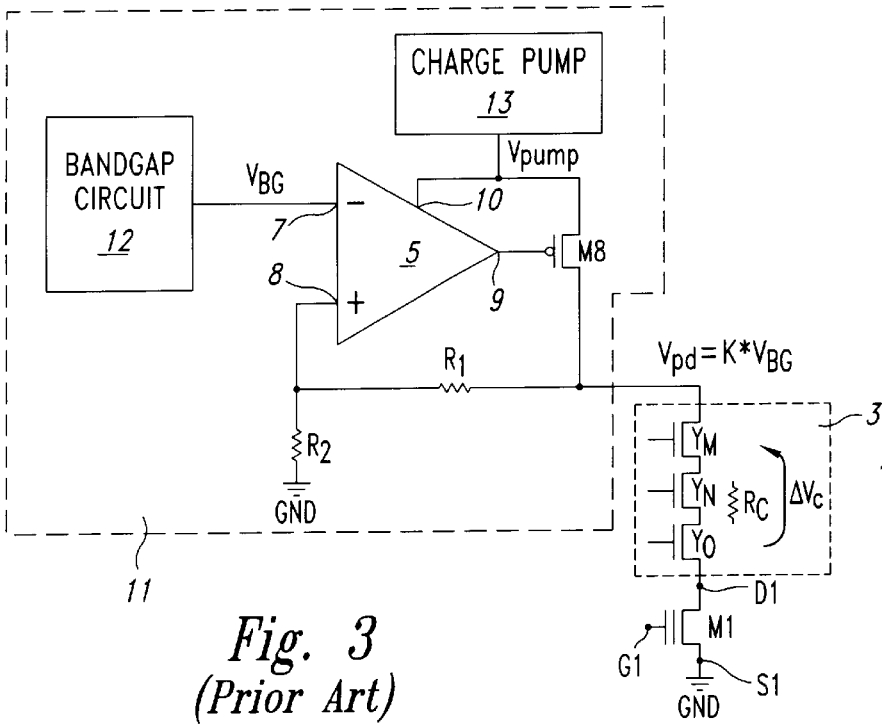
Fig. 3 (Prior Art)
FIG. 3 shows a feedback differential regulator without adjustment feature for a conventional memory cell with single supply voltage.

Referring to the drawing figures, generally and schematically shown at 14 is a temperature-related voltage generating circuit according to the invention.

The temperature-related voltage generating circuit 14 has an input terminal 15 receiving a control voltage $V_{BG}$ independent of temperature, and an output terminal 16 delivering an output voltage, specifically a temperature-related control voltage Vout.

In particular, the control voltage $V_{BG}$ independent of temperature is derived from a conventional bandgap circuit.

The temperature-related voltage generating circuit 14 comprises first 17, second 18, and third 19 amplifier stages, e.g., operational amplifiers. In particular, the input terminal 15 is connected to the non-inverting terminal of the first amplifier stage 17, having its inverting input terminal connected to the output terminal such as to form a buffer for the control voltage $V_{BG}$ independent of temperature presented on the output terminal of said first amplifier stage 17.

This output terminal of the first amplifier stage 17 is in turn connected to the non-inverting input terminal of the second amplifier stage 18, and to the ground voltage reference GND through a bipolar transistor T1, specifically a PNP type, which functions as an element generating a varying voltage $V_{BE}$ with temperature according to a known law.

The temperature-related voltage generating circuit 14 can be configured, in a manner known to those skilled in the art, to use either a bipolar transistor of the NPN type or an NMOS transistor suitably configured as a diode, for the element generating the varying voltage $V_{BE}$ with temperature.

Figure 4:
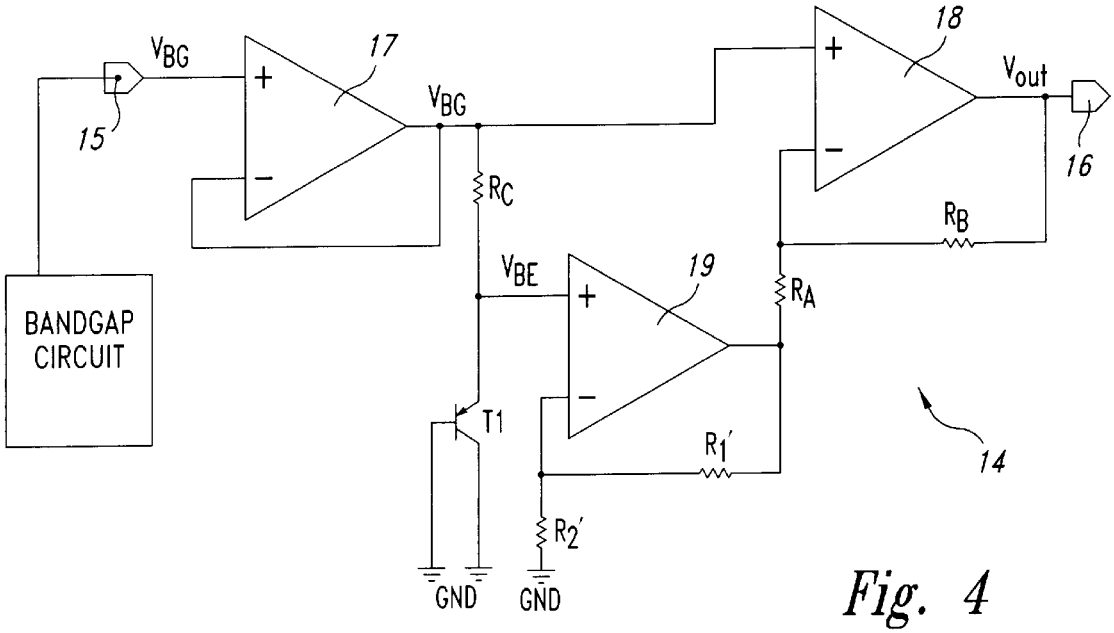
FIG. 4 shows a temperature-related voltage generating circuit according to the invention.

The bipolar transistor T1 shown in the embodiment of FIG. 4 has its base and collector terminals connected to the ground voltage reference GND and the emitter terminal connected to the non-inverting input terminal of the third amplifier stage 19.

The third amplifier stage 19, in turn, has its inverting input terminal connected to its output terminal through a first resistive element R1' of a first resistive divider R1'/R2', and to the ground voltage reference GND through a second resistive element R2' of said first divider. Likewise, the second amplifier stage 18 has its inverting input terminal connected to the output terminal of the third amplifier stage 19 through a first resistive element RA of a second resistive divider RA/RB, and to the output terminal 16 of the temperature-related voltage generating circuit 14 through a second resistive element RB of said second divider.

Finally, the non-inverting input terminal of the third amplifier stage 19 is connected to the output terminal of the first amplifier stage 17, and to the non-inverting input terminal of the second amplifier stage 18 via a further decoupling resistive element RC.

This third amplifier stage 19 acts generally to amplify the varying voltage $V_{BE}$ with temperature, specifically to provide a multiple of said varying voltage $V_{BE}$ with temperature to an input of the second amplifier stage 18. The second amplifier stage 18 is generally to evaluate the difference between the control voltage $V_{BG}$ independent of temperature and s aid voltage being a multiple of the varying voltage $V_{BE}$ with temperature which exists between the base and emitter terminals of the bipolar transistor T1.

Since the base-emitter voltage $V_{BE}$ decreases as temperature increases at a constant differential (in particular, equal to−2 mV/degree), the temperature-related control voltage Vout of the temperature-related voltage generating circuit 14 will rise linearly with temperature.

This statement can be demonstrated by drawing the following relations from the temperature-related voltage generating circuit 14:

$$Vout=V_{BG}+(V_{BG}-V_{BE})(RB/RA)-(RB/RA)(R1'/R2')V_{BE} \quad (3)$$

and therefore:

$$\delta Vout/\delta T=-(1+R1'R2')(RB/RA)\delta V_{BE}/\delta T \quad (4)$$

If the value of the control voltage $V_{BG}$ independent of temperature is 1.4 V and the resistive elements of the first divider R1'/R2' have the same resistance, since the base-emitter voltage $V_{BE}$ is substantially 0.7 V at room temperature, it is found from relation (3) that Vout is equal to the control voltage $V_{BG}$ in dependent of temperature, for any value of the resistive ratio RB/RA of the second resistive divider.

Figure 5:
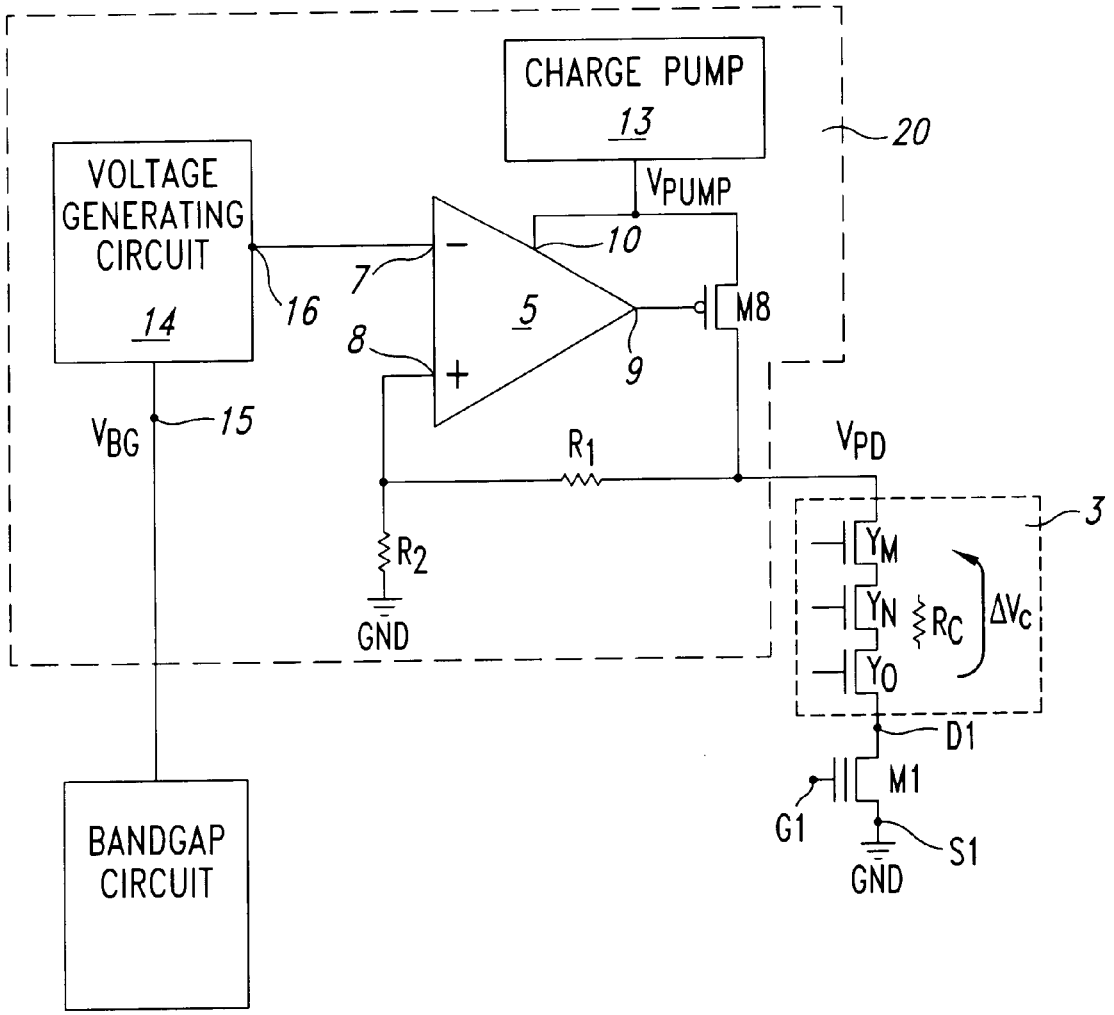
FIG. 5 shows a differential regulator for a memory cell having a single supply voltage, which incorporates a temperature-related voltage generating circuit according to the invention.

When this temperature-related control voltage Vout is applied to the inverting input terminal 7 of a differential stage 5 in a feedback differential regulator 11 with no adjustment feature, a regulator 20 according to the invention is obtained as schematically shown in FIG. 5.

In particular, the regulator 20 of this invention supplies a secondary program voltage Vpd which increases with temperature.

Furthermore, on the grounds of relations (3) and (4) above, it can be verified that when R1'=R2' the following relation also applies:

$$\delta Vout/\delta T=-2RA/RB*\delta V_{BE}/\delta T \quad (5)$$

In other words, the differential of the temperature-related control voltage Vout is positive and proportional to the ratio of the second resistive divider RB/RA.

In summary, the temperature-related voltage generating circuit 14 and regulator 20 of this invention afford a number of advantages, among which are those listed herein below.

The temperature-related voltage generating circuit 14 supplies a temperature-related control voltage Vout which is derived from the control voltage $V_{BG}$ of a bandgap circuit, and hence independent of temperature by definition.

Accordingly, the values of the control voltage $V_{BG}$ independent of temperature can be selected as appropriate to obtain a given temperature-related control voltage Vout.

The values of the resistive elements R1' and R2' of the first resistive divider can be selected such that, at room temperature, the output voltage from the temperature-related voltage generating circuit 14—that is, the temperature-related control voltage Vout—equals the control voltage VBG independent of temperature.

In this case, the temperature-related voltage generating circuit 14 can be employed in a generic voltage regulator for a non-volatile memory cell which uses a control voltage $V_{BG}$ independent of temperature derived from a bandgap circuit, with no need for redesigning the regulator.

The temperature-related voltage generating circuit 14 outputs a temperature-related control voltage Vout which increases linearly with temperature, so that the regulator 20 to which this temperature-related voltage generating circuit 14 is connected will have a secondary program voltage Vpd=K*Vout which increases with temperature.

Thus, with the drain voltage Vd of the memory cell M1 to be programmed given as $Vd=Vpd-\Delta V_C$ (according to relation (1) brought forward above in connection with the prior art), the temperature-related voltage generating circuit 14 as applied to a regulator 20 for a memory cell M1 allows the average increase in the voltage drop $\Delta V_C$ across the column decoder 3 connected to the memory cell M1 to be adjusted by means of the equivalent increase in the secondary program voltage Vpd, thereby ensuring an invariance of the drain voltage Vd for the memory cell M1 against temperature.

In conclusion, the regulator 20 with the temperature-related voltage generating circuit 14 enables programming of a memory cell M1, in particular one having a single supply voltage, without accounting for variations due to temperature.

From the foregoing it will be appreciated that, although specific embodiments of the invention have been described herein for purposes of illustration, various modifications may be made without deviating from the spirit and scope of the invention. Accordingly, the invention is not limited except as by the appended claims.

We claim:

1. A temperature-related voltage generating circuit, comprising an input terminal receiving a control voltage independent of temperature; an output terminal delivering a temperature-related control voltage, said input and output terminals being connected together through at least an amplifier stage adapted to set an output reference voltage from a comparison of input voltages; a generator element generating a varying voltage with temperature connected between a ground voltage reference and a non-inverting input terminal of said amplifier stage, which has an output terminal adapted to deliver a multiple of the varying voltage with temperature to all inverting input terminal of a comparator stage; said comparator stage has an output terminal connected to the output terminal of the temperature-related voltage generating circuit and a non-inverting input terminal receiving said control voltage independent of temperature to evaluate a difference between the control voltage independent of temperature and said voltage being a multiple of the varying voltage with temperature and to output said temperature-related control voltage which has at room temperature a mean value which is independent of said temperature-related control voltage thermal differential and increases with temperature.

2. A temperature-related voltage generating circuit according to claim 1, wherein said comparator stage has its non-inverting input terminal connected to the non-inverting input terminal of the amplifier stage and to the input terminal of the temperature-related voltage generating circuit, and has its inverting input terminal connected to the output terminal thereof, itself connected to the output terminal of the temperature-related voltage generating circuit.

3. A temperature-related voltage generating circuit according to claim 2, wherein said amplifier stage has an inverting input terminal connected to its output terminal through a first resistive element of a resistive divider, and to a ground voltage reference through a second resistive element of said resistive divider.

4. A temperature-related voltage generating circuit according to claim 2, wherein said comparator stage has its inverting input terminal connected to the output terminal of the amplifier stage through a first resistive element of a resistive divider, and to the output terminal of the temperature-related voltage generating circuit through a second resistive element of said resistive divider.

5. A temperature-related voltage generating circuit according to claim 2, wherein the non-inverting input terminal of the amplifier stage is connected to the input terminal of the temperature-related voltage generating circuit and to the non-inverting input terminal of the comparator stage through a decoupling resistive element.

6. A temperature-related voltage generating circuit according to claim 1, wherein said generator element generates a varying voltage with temperature and comprises, in particular, a bipolar transistor having base and collector terminals connected to the ground voltage reference and its emitter terminal connected to the non-inverting input terminal of the amplifier stage, said varying voltage with temperature being a voltage which exists between the base terminal and an emitter terminal of the bipolar transistor, and said amplifier stage performing an amplification of said varying base-emitter voltage with temperature, to input a multiple of the base-emitter voltage to the comparator stage for performing an evaluation of a difference between the control voltage independent of temperature and said multiple of the base-emitter voltage.

7. A temperature-related voltage generating circuit according to claim 1, wherein said generator element comprises either an NPN bipolar transistor or an NMOS transistor in a diode configuration.

8. A temperature-related voltage generating circuit according to claim 1, further comprising a decoupler stage connected to said amplifier stage and to the input terminal of the temperature-related voltage generating circuit, and having a non-inverting input terminal connected to the input terminal of the temperature-related voltage generating circuit as well as an inverting input terminal connected to an output terminal of the decoupler stage, the decoupler stage also being connected to the non-inverting input terminal of the amplifier stage, thereby providing a buffer for the control voltage independent of temperature presented on the input terminal of the temperature-related voltage generating circuit.

9. A temperature-related voltage generating circuit according to claim 1, wherein said control voltage independent of temperature is supplied from a bandgap circuit.

10. A regulator for a drain voltage of a single-supply memory cell, comprising;

a differential stage having an inverting input terminal receiving a control voltage independent of temperature, a non-inverting input terminal connected to a ground voltage reference (GND), and an output terminal connected to the non-inverting input terminal;

a booster circuit connected to said output terminal and to a supply terminal of tile differential stage, said supply terminal being feedback connected to the output terminal and receiving a boosted voltage (Vpump) from the booster circuit; and a temperature-related voltage generating circuit, comprising an input terminal receiving a control voltage independent of temperature, an output terminal delivering a temperature-related control voltage, said input and output terminals being connected together through at least an amplifier stage adapted to set an output reference voltage from a comparison of input voltages; a generator element generating a varying voltage with temperature connected between a ground voltage reference and a non-inverting input terminal of said amplifier stage, which has an output terminal adapted to deliver a multiple of the varying voltage with temperature to an inverting input terminal of a comparator stage; said comparator stage has an output terminal connected to the output terminal of the temperature-related voltage generating circuit and a non-inverting input terminal receiving said control voltage independent of temperature to evaluate a difference between the control voltage independent of temperature and said voltage being a multiple of the varying voltage with temperature and to output said temperature-related control voltage which has at room temperature a mean value which is independent of said temperature-related control voltage thermal differential and increases with temperature, said temperature-related voltage generating circuit being adapted to supply a temperature-related control voltage to the inverting input terminal of the differential stage such that a secondary program voltage is obtained for the memory cell at a constant value, at room temperature, the regulator enabling an adjustment to be made of an average increase of a voltage drop across a column decoder connected to the memory cell by means of an equivalent increase in the secondary program voltage, thereby ensuring invariance of a drain voltage of the memory cell with temperature.

11. A circuit, comprising:

an input terminal receiving a temperature-independent control voltage;

an output terminal delivering a temperature-dependent output voltage;

a voltage generator coupled to the input terminal and structured to produce a temperature-dependent voltage reference signal; and a comparator having first and second input terminals and an output terminal, the first input terminal being coupled to the input terminal of the circuit, the second input terminal being coupled to the voltage generator and the comparator output terminal being coupled to the output terminal of the circuit, the comparator being structured to compare the control voltage to the reference voltage and produce the output voltage based on the comparison.

12. The circuit of claim 11 wherein the voltage generator includes a generator element and an amplifier having first and second input terminals and an output terminal, the generator element being coupled to the input terminal of the circuit and to the first input terminal of the amplifier, the second input terminal of the amplifier being coupled to the output terminal of the amplifier and to the second input terminal of the comparator, the generator element generating a temperature-dependent control voltage which the amplifier amplifies to produce the temperature-dependent reference voltage.

13. The circuit of claim 12 wherein the generator element includes a transistor having a first conductive terminal coupled to the first input terminal of the amplifier and a second conductive terminal coupled to a ground voltage reference.

14. The circuit of claim 12 wherein the voltage generator also includes a resistive divider having a first resistive element coupled between a ground voltage reference and the second input terminal of the amplifier and a second resistive element coupled between the second input and output terminals of the amplifier.

15. The circuit of claim 14 wherein the first and second resistive elements are sized to ensure that the output voltage substantially equals the control voltage at room temperature.

16. The circuit of claim 14 wherein the voltage generator also includes a third resistive element coupled between the output terminal of the amplifier and the second input terminal of the comparator and the circuit also includes a fourth resistive element coupled between the second input and output terminals of the comparator.

17. The circuit of claim 16, further comprising a decoupling amplifier and a decoupling resistive element; the decoupling amplifier having a first input terminal coupled to the input terminal of the circuit; a second input terminal coupled by the decoupling resistive element to the first input terminal of the amplifier; and an output terminal coupled to input terminal of the decoupling amplifier, the decoupling resistive element, and the first input terminal of the comparator.

18. The circuit of claim 11, further comprising a differential stage having a first input that receives a boosted voltage, a second input that receives the temperature-dependent output voltage, and an output that provides a temperature-dependent programming voltage to a memory element, which compensates for temperature-dependent voltage drops of a column decoder coupled to the memory element.

19. A method of providing a temperature-dependent output voltage, the method comprising:

receiving a temperature-independent control voltage;

generating a temperature-dependent reference voltage;

comparing the reference voltage to the control voltage; and producing the temperature-dependent output voltage based on the comparising wherein the output voltage is substantially equal to the control voltage at room temperature.

20. The method of claim 19 wherein the generating act includes generating a temperature-dependent input voltage and amplifying the input voltage to obtain the reference voltage.

21. The method of claim 19, further comprising providing the output voltage to a regulator stage that employs the output voltage to provide a temperature-dependent programming voltage to a memory cell and compensate for an increase in a voltage drop, due to temperature, of a column decoder coupled to the memory cell.

* * * * *

UNITED STATES PATENT AND TRADEMARK OFFICE

CERTIFICATE OF CORRECTION

PATENT NO. : 6,184,670 B1
DATED : February 6, 2001
INVENTOR(S) : Jacopo Mulatti et al.

It is certified that error appears in the above-identified patent and that said Letters Patent is hereby corrected as shown below:

Column 7,
Line 54, "all inverting input terminal" should read as -- an inverting input terminal --.

Column 9,
Line 2, "tile differential stage," should read as -- the differential stage --.

Signed and Sealed this

Twenty-first Day of May, 2002

*Attest:*

*Attesting Officer*

JAMES E. ROGAN
*Director of the United States Patent and Trademark Office*